United States Patent [19]

Ravn et al.

[11] 4,204,605

[45] May 27, 1980

[54] CONTAINER-CLOSURE ASSEMBLY

[75] Inventors: Jacob Ravn, Phoenixville; William A. Conard, Norristown, both of Pa.

[73] Assignee: The West Company, Phoenixville, Pa.

[21] Appl. No.: 940,607

[22] Filed: Sep. 8, 1978

[51] Int. Cl.[2] ..... B65D 41/62

[52] U.S. Cl. ..... 215/295; 206/222

[58] Field of Search ..... 215/31, 295, DIG. 8, 215/6, 247, 248, 249, DIG. 3; 206/222

[56] References Cited

U.S. PATENT DOCUMENTS

| | | | |
|---|---|---|---|
| 1,724,213 | 8/1929 | McDonnell | 215/295 |
| 1,814,650 | 7/1931 | Waite | 215/DIG. 3 |
| 2,069,075 | 1/1937 | Lunn | 215/295 |
| 2,177,396 | 10/1939 | Watson | 215/31 |
| 3,603,469 | 9/1971 | Magni | 215/DIG. 8 |

*Primary Examiner*—Donald F. Norton

*Attorney, Agent, or Firm*—Eugene E. Renz, Jr.

[57] ABSTRACT

A container-closure assembly. The container has a discharge opening, a locking flange of generally circular opening with a frusto conical side face diverging downwardly from the axial end face of the opening. A shaping surface is formed below the locking flange of non-circular cross section and has a maximum cross section less than the cross section of the locking flange and at least one cam member extends axially downwardly from the locking flange. The cap of the assembly has a top and a peripheral skirt portion engaging under the locking flange and extending at least to the juncture of the locking flange and shaping surface. The cap is of a deformable material whereby the skirt is shaped to a generally circular shape by the cam member upon relative rotation of the cap and container.

16 Claims, 13 Drawing Figures

CONTAINER-CLOSURE ASSEMBLY

BACKGROUND OF THE INVENTION

The present invention relates to container-closure assemblies and more specifically to a container-closure assembly characterized by novel features of construction and arrangement facilitating easy and quick application of the closure to the container and ready removal thereof.

In the process of removing the closure from the container, there is visual indication evidenced by change in the configuration or shape of the closure and thus the assembly may be referred to as a "tamper-proof" assembly.

Closures or caps of the type to which the present invention relate are usually of a deformable material such as thin gauge aluminum which are conformed to threads or grooves in the container finish. In these assemblies, the cap once seated on the container finish is removed by rotation relative to the container which results in deformation of the cap permitting it to be removed in an axial direction from the container. Examples of prior container-closure assemblies of this type are shown in the following patents:

Magni—U.S. Pat. No. 3,603,469—Sept. 7, 1971
Booth—U.S. Pat. No. 2,139,572—Dec. 6, 1938
Sharp—U.S. Pat. No. 1,796,728—Mar. 17, 1931
Thomas—U.S. Pat. No. 2,298,777—Oct. 13, 1942
Hammer—U.S. Pat. No. 1,027,330—May 21, 1921

Even though these assemblies operate in a generally satisfactory manner, it has been found that in some instances the caps are difficult to release from the container by application of normal hand applied force. With this in mind, an object of the present invention is to provide an assembly wherein the closure or cap may be securely seated or locked in place on the container and application of normal hand applied forces to rotate the cap result in relatively easy and sure release of the cap from the container by reason of the novel construction and configuration of the container finish.

SUMMARY OF THE INVENTION

In accordance with the principal embodiment of the invention the container finish includes a radially outwardly directed locking flange adjacent the discharge opening of the container which has a downwardly divergent conical side face and a shaping collar of elliptic cross section below the flange with at least a pair of cam members at diametrically opposed locations on the major axis of the shaping collar which also have a downwardly divergent face coincident with and forming an extension of the conical face of the locking flange. The closure or cap which is preferably of a deformable metallic material, such as aluminum, has a peripheral skirt portion initially of generally cylindrical shape which is adapted to be engaged over the locking flange by conventional forming equipment so that the lower terminal edge of the skirt is disposed adjacent the juncture of the locking flange and the shaping collar intermediate the cam members in the locked or seated position of the closure on the container. By this construction, when it is desired to remove the cap, it is simply rotated through approximately 180°. During this turning action, the skirt of the cap is deformed by the cam members to a generally cylindrical shape of a slightly greater diametral dimension than the largest diameter of the locking flange to permit easy removal of the cap in an axial direction from the container. Also it should be noted that the cap skirt is in frictional contact with the bottle finish along two very small arcuate lines that define the width of the cam faces on the major axis. The conical face of the locking flange permits easy passage of the skirt upon removal even if there is some spring back of the skirt. In some applications the cap seats a stopper against the container to provide a hermetic seal and the rotation of the cap deforming the skirt to a cylindrical shape provides visual indication that the seal may have been disturbed and thus the assembly may be termed "tamper proof".

With the above in mind an object of the present invention is to provide a container-closure assembly characterized by novel features of construction and arrangement facilitating easy and quick application and removal of the closure from the container.

Another object of the present invention is to provide a novel container-closure assembly which is relatively economical to manufacture and assemble.

Another still further object of the present invention is to provide a closure finish of a predetermined configuration including a locking flange having a conical downwardly diverging side face, an elliptically shaped collar portion below the locking flange and circumferentially spaced cam members having downwardly diverging peak surfaces which in combination with the cap provide a secure mounting in the locked position and effect upon rotation of the cap deformation of the skirt so that it may be easily removed.

BRIEF DESCRIPTION OF THE DRAWINGS

These and other objects of the present invention and the various features and details of the operation and construction thereof are hereinafter more fully set forth with reference to the accompanying drawings, wherein.

DESCRIPTION OF THE PREFERRED EMBODIMENTS

Figure 1:
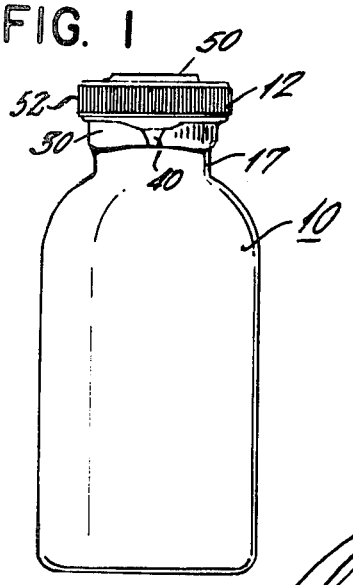
FIG. 1 is a side elevational view of a container-closure assembly constructed in accordance with the present invention.
Figure 2:
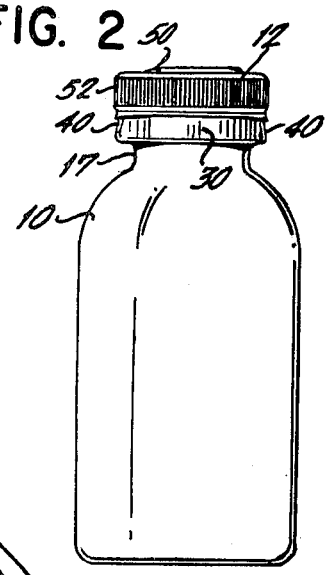
FIG. 2 is also a side elevational view of a container-closure assembly turned 90°.

Referring now to the drawings and particularly to FIGS. 1-4 thereof, there is illustrated a container-closure assembly in accordance with the present invention. The assembly is particularly adapted for medicaments which require a hermetic seal and essentially comprises a container such as a bottle 10 and a closure in the form of a cap 12 which, in the present instance, seats a stopper 14 in the discharge opening 16 in the neck 17 of the container 10. The stopper 14 is of generally conventional design and includes a disc-like top 18 and depending plug portion 20, the outer peripheral portion of the top seating against the axial end face 21 of the container in the manner shown in FIG. 3. The container 10 may be made of a variety of materials but is preferably made of glass and the cap 12 is preferably made of a readily deformable metallic material such as thin gauge aluminum.

Figure 4:
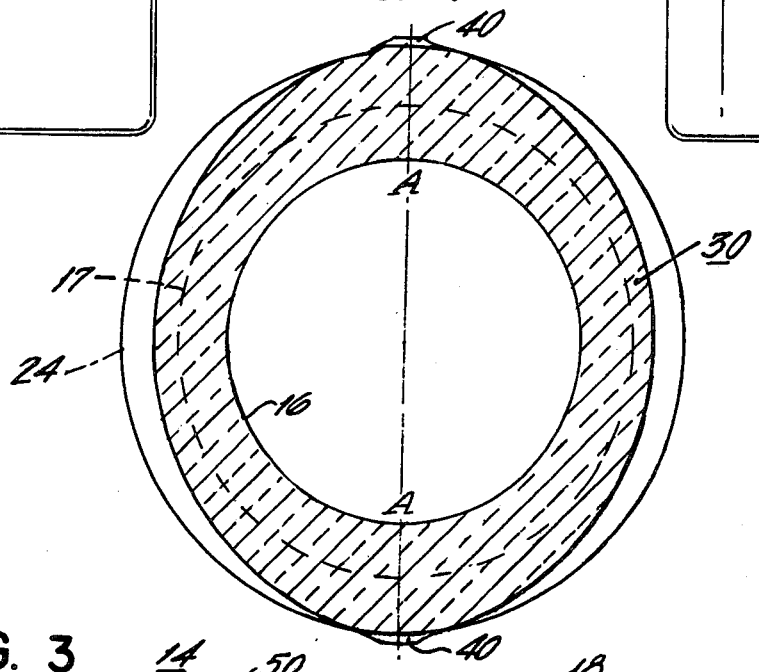
FIG. 4 is a sectional view taken on lines 4—4 of FIG. 3.
Figure 3:
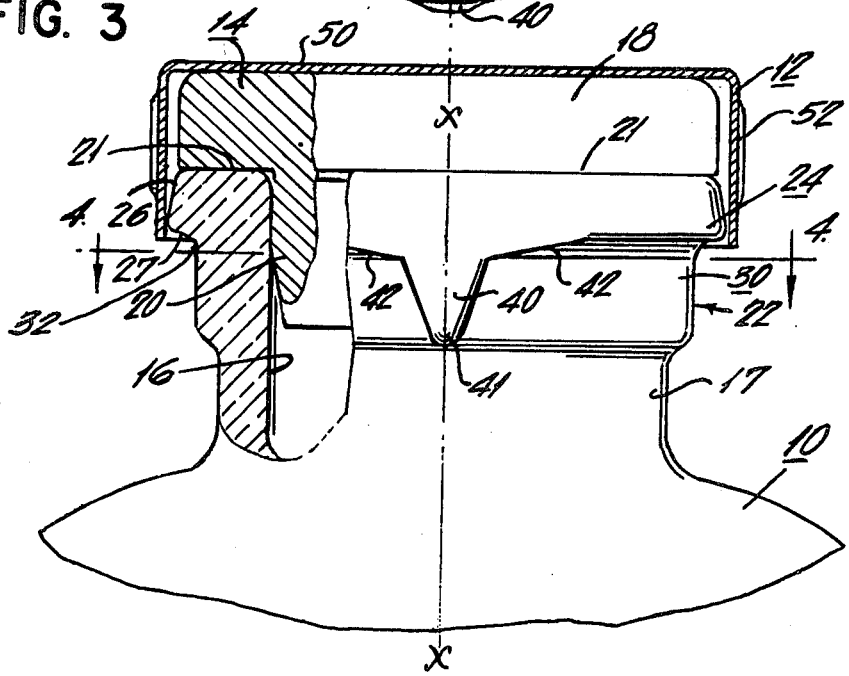
FIG. 3 is an enlarged fragmentary sectional view showing the closure prior to final assembly to the container.
Figure 5:
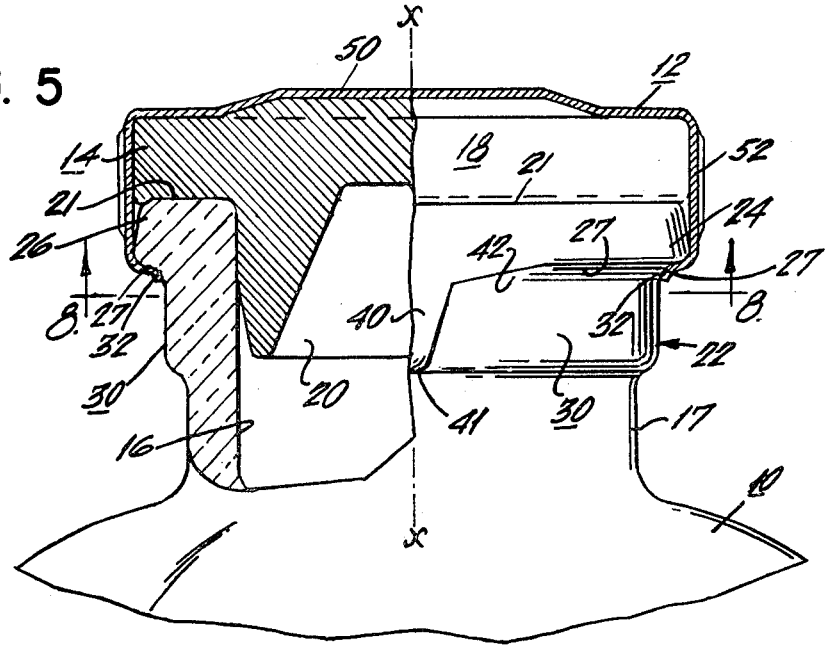
FIG. 5 is a fragmentary sectional view showing the closure in assembled relation on the container.
Figure 6:
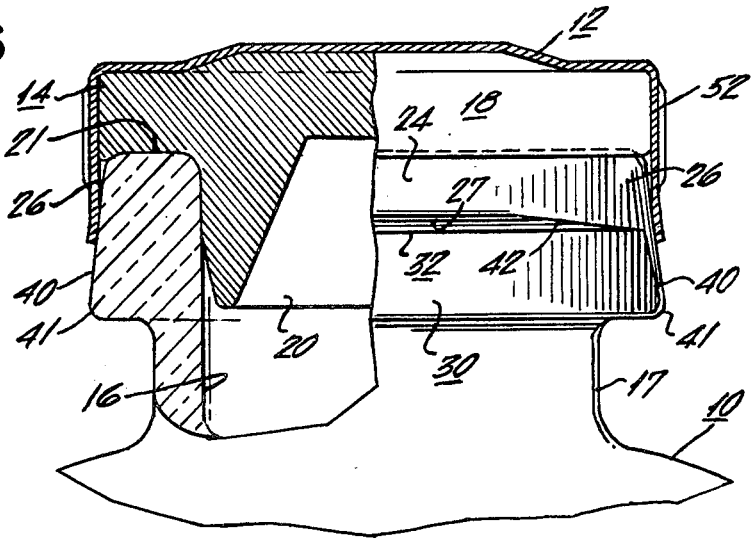
FIG. 6 is a fragmentary sectional view similar to FIG. 5 with the closure rotated 90°.

In accordance with the present invention, the bottle finish generally designated by the numeral 22 is of a predetermined shape or configuration to provide a firm locking means for the cap so that the cap has a good capacity to withstand axial loads and also a relatively simple means for removing the cap by rotation when desired in a trouble-free manner. To this end, the finish 22 includes a radial, outwardly directed, circumferentially extending locking flange 24 adjacent the axial end face 21 of the neck of the container which has a downwardly diverging conical side face 26. The lower face of the flange 24 is generally radially directed and inclined upwardly at a slight angle to define a locking shoulder or face 27 for the cap in a manner to be described in more detail below. The conical side face 26 is preferably disposed at an angle of as great as about nine degrees (9°) to the central axis X—X of the container. The lower face of the locking rib merges with a shaping collar 30 which as illustrated in FIG. 4 is of elliptical cross section. The axial end face 21 and side face 26 of locking flange 24 merge in a gently curved edge. Likewise the juncture of the side face 26 and locking shoulder 27 and the juncture 32 of shoulder 27 and shaping collar 30 are defined by gently curved edges. In the present instance, two triangularly shaped cam members 40 are formed integrally with the locking flange and shaping collar which are located at diametrically opposed locations on the major axis A—A of the elliptical shaping collar. These cams 40 as illustrated in FIG. 6 are downwardly divergent at an angle as great as about nine degrees (9°) and as illustrated have a peak edge 41 which is a continuation of the side face 26 of the locking flange. Gentle inclined ramp surfaces 42 on either side of the cams 40 are provided which merge with the lower edge of the locking flange in the manner illustrated in FIGS. 3, 5 and 6.

The closure or cap 12 is of cup-like form including a generally circular top 50 and a depending cylindrical skirt 52 which is knurled to facilitate turning of the cap on the container to remove it. The skirt 52 is of a predetermined length so that the lower edge engages at the juncture 32 of the lower face of the locking flange 24 and the elliptical shaping collar 30 when fully assembled in the manner shown in FIGS. 5 and 7. In this manner as illustrated in FIG. 6, the portion of the skirt confronting and overlying the cams 40 is slightly outwardly bent and edge of the skirt between the cams 40 engages under the shoulder 27 extending to the juncture 32 of the shoulder 27 and shaping collar 30 and in this position is securely locked in place. The trace of the terminal edge of the skirt in the locked position is then essentially elliptical following the contour of the shaping collar.

The cap which is preferably of thin gauge aluminum is applied to the container by conventional rolling techniques and equipment including means for pressing the top axially on the container to slightly compress the disc portion 18 of the stopper 14 and rolling elements to turn under the lower terminal edge of the skirt to the position shown in the drawings. Now when it is desired to remove the cap, the user simply supports the container or bottle 10 in one hand and uses the other hand to grip the skirt of the cap and rotate it relative to the container. Upon rotation of the cap through approximately 180°, the portion of the skirt intermediate the cams passes over the cams 40 and is deformed to a circular shape of a diameter slightly greater than the maximum diameter of the locking flange. The inclined ramp surfaces 42 facilitate a smooth turning and deformation action. In this position the cap may be simply removed axially from the container to expose the stopper. It is noted that there may be some spring back in the lower edge of the skirt and the divergent conical side face of the locking flange prevents binding of the skirt since it is of reduced diameter toward its upper edge. The engagement of the lower edge of the skirt with the inclined cam lead and the gently rounded cam faces facilitates smooth and easy deformation of the turned in lower edge of the skirt to a circular shape with a slight outward bend providing for ease of complete removal from the container. Note also that the stopper snugly nests in the cap when in a locked position. (See FIGS. 5 and 6). However, the disc portion 18 of the stopper in its relaxed state is of substantially smaller diameter than the skirt of the cap so that as the cap is moved axially to remove it, the stopper contracts as the axial pressure is relieved so that the stopper is not withdrawn from the opening in the container with removal of the cap.

Figure 7:
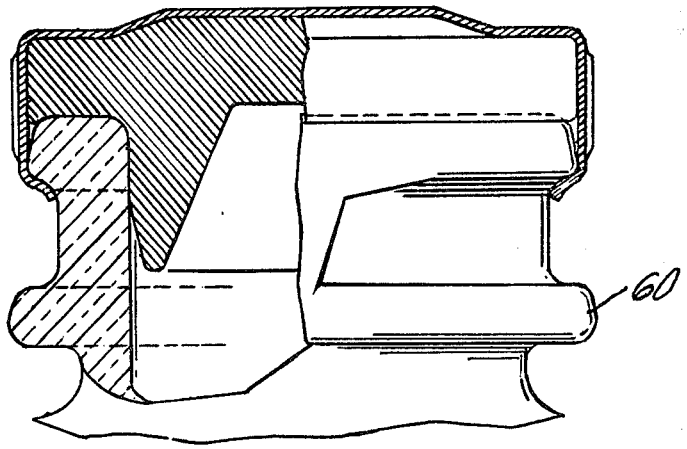
FIG. 7 is a fragmentary sectional view of a slightly modified container-closure assembly in accordance with the present invention.
Figure 8:
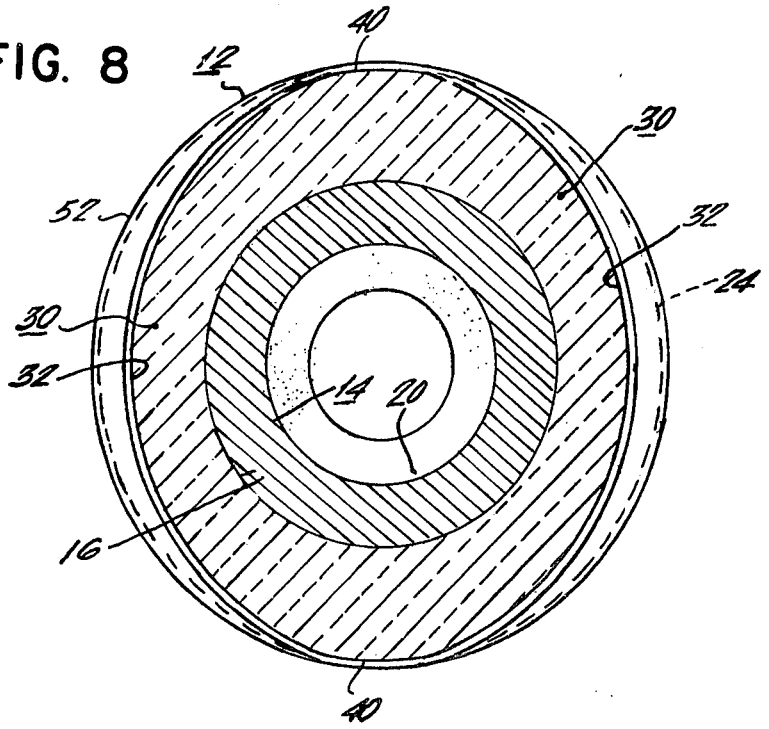
FIG. 8 is a sectional view taken on lines 8—8 of FIG. 5 showing the closure in a locked or assembled position.
Figure 9:
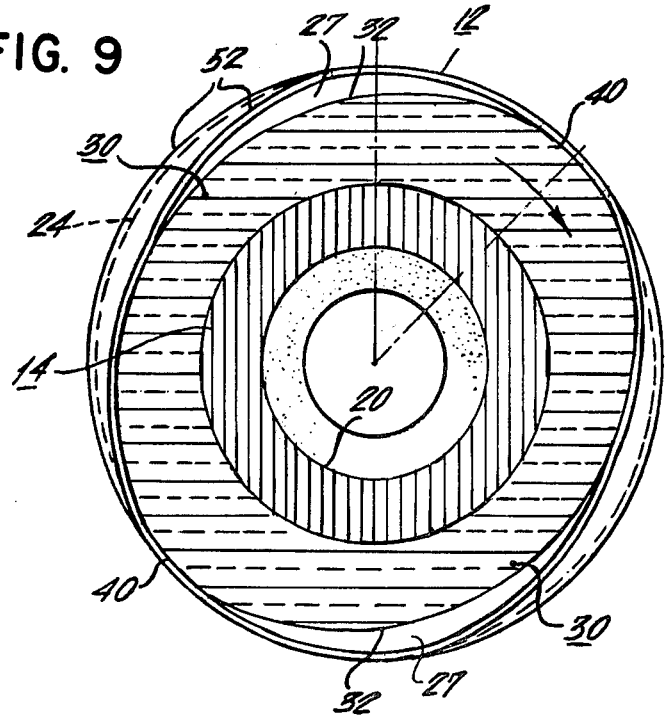
FIG. 9 is a view similar to FIG. 8 showing the closure or cap in a partially unlocked position.
Figure 10:
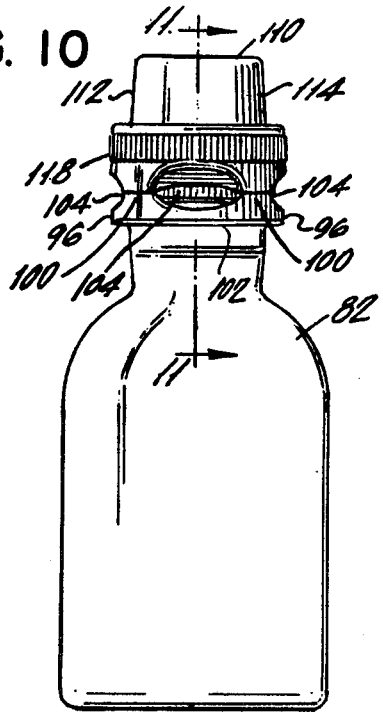
FIG. 10 is a side elevational view of another modification of a container-closure assembly constructed in accordance with the present invention.
Figure 12:
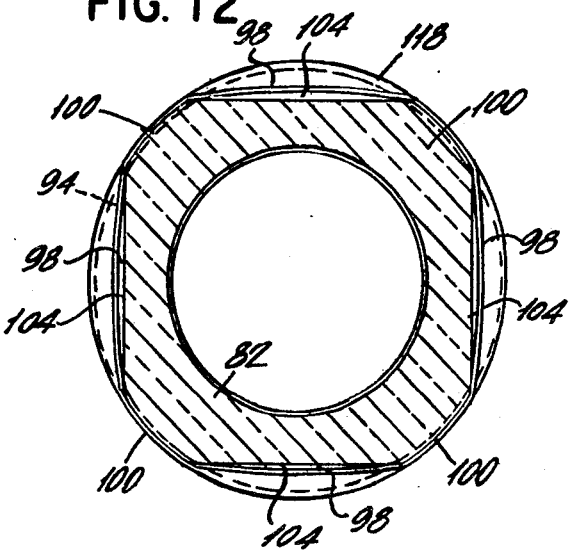
FIG. 12 is a sectional view taken on the lines 12, 12 of FIG. 11 showing the closure in a locked or assembled position.
Figure 11:
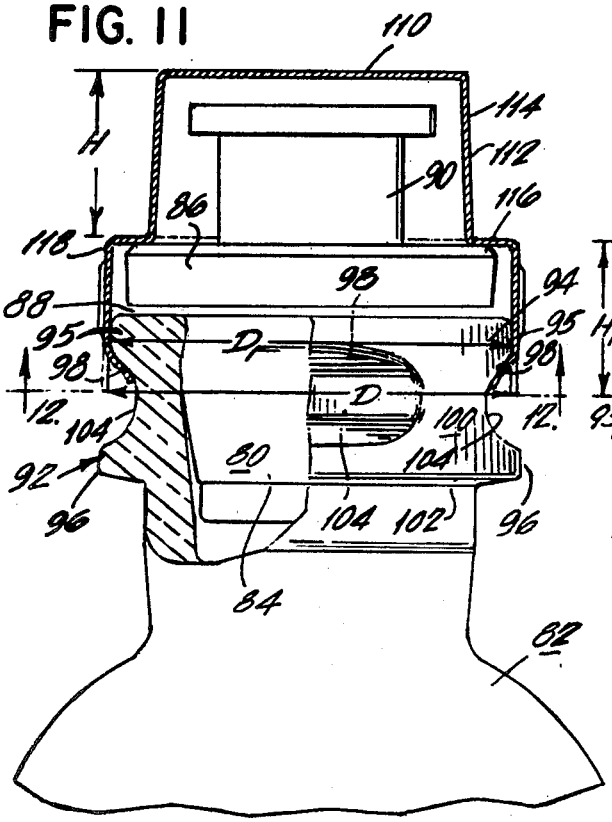
FIG. 11 is an enlarged transverse fragmentary sectional view taken on the lines 11, 11 of FIG. 10.
Figure 13:
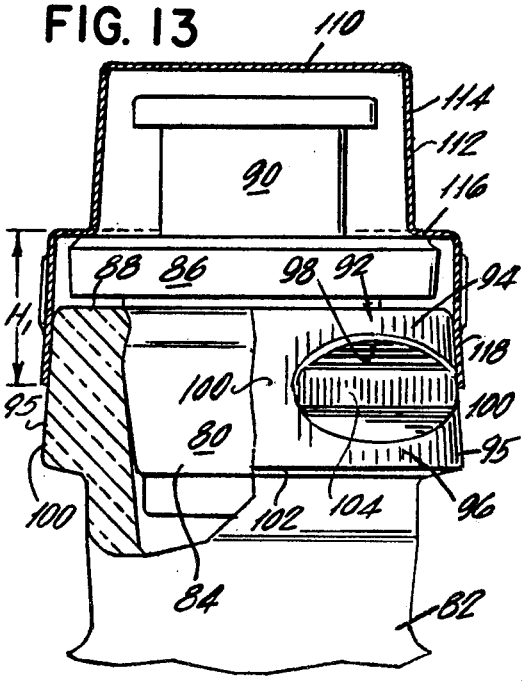
FIG. 13 is an enlarged fragmentary sectional view similar to FIG. 11, but rotated 45°.

The container-closure assembly of FIG. 7 is identical to that described above except that the container finish includes a second radial projection of flange 60 spaced axially below the shaping collar. This projection 60 which is of circular cross section and of a slightly larger diameter than the locking flange, aids in the formation of the container when it is made of glass and also provides a support or back up surface for the forming rollers employed to shape the skirt of the cap to the bottle finish.

There is illustrated in FIGS. 10-13 another embodiment of container-closure assembly in accordance with the present invention. The closure assembly is also designed for hermetically sealing containers and the like. In this instance the assembly is designed to accommodate an auxiliary container 80 for a product to be mixed with the contents of the main container 82 when it is ready for use. For example, one product could be a solvent or dispersing liquid in the main container and the other product may be a solid substance in granular or pulverulent condition which must be maintained in a hermetically sealed condition and separated from the solvent for good shelf life until just prior to use. The auxiliary container 80 is not new per se and includes pilot or plug portion 84 engaging in the neck of the bottle having a flange 86 which seats against the axial end face 88 of the container. Telescopically mounted in the auxiliary container is a cutting element 90 adapted to puncture the bottom wall of the auxiliary container to provide a discharge opening for mixing the contents thereof with the contents in the main container.

In accordance with this embodiment of the invention, the bottle finish generally designated by the numeral 92 includes a radial outwardly directed, circumferentially extending locking flange 94 adjacent the upper discharge end of the bottle neck which is of circular configuration, a second radial outwardly directed flange 96 spaced axially downwardly from the flange 94 which is also of circular configuration and of a diameter slightly larger than the diameter of the flange 94. The locking flange 94 has a conical face 95 which is downwardly divergent and a lower face 98 under which the skirt of the closure is crimped in the manner described below. Spanning the flanges 94 and 96 are, in the present instance, four axially extending, circumferentially spaced cam members 100 in the form of ribs having a contoured outer face. The peak surface 102 of each of the cams is downwardly divergent and forms a continuation of the conical face 95 of the locking flange 94. The exterior surface of the container finish intermediate the cam elements is planar comprising opposing shaping walls or surfaces 104. The walls of the shaping surfaces in opposing quadrants are substantially parallel to define a square cross section configuration. Note the corner to corner and wall to wall dimension of the shaping walls or surfaces 104 is less than the diameter of the locking flange.

The closure cap which is made of a thin light gauge deformable metallic material such as aluminum comprises a disc like top 110 having a dependent peripheral skirt 112 which in the present instance is initially of stepped configuration defining an upper dome section 114, an outwardly directed connecting radial wall 116 and a lower skirt portion 118. The radial wall 116 of the cap seats against the upper face of the flange 86 of auxiliary container in the manner illustrated in FIGS. 11 and 13 and the dome section 114 is preferably of an axial height H to provide a head clearance between the cutter element and top of the cap. This arrangement precludes actuation of the cutting element until the cap has been removed. As illustrated the lower skirt portion 118 is of a diameter D larger than the greatest diameter $D_1$ of the locking flange to permit easy assembly of the cap prior to rolling the skirt under the flange in the final assembly. The skirt is of an axial depth $H_1$ so that the lower terminal edge engages under the lower locking face of the locking flange and extends inwardly to the juncture of the shaping wall at its minimum cross section C.

In assembling the elements of the container-closure assembly of the present invention, the main container is filled with product and thereafter the auxiliary container with another product to be mixed at a future time with the product in the main container is inserted into the neck of the container and then the closure cap is placed over the auxiliary container. Note that the lower skirt portion 118 of the closure cap is initially straight and engages with a clearance over the locking flange. Pressure is then applied on the radial wall 116 to firmly seat the auxiliary closure against the axial end face of the container to provide a hermetic seal. The lower terminal edge of the skirt of the cap is then rolled under to the locked position. The lower flange 96 serves as a support means for the rollers in certain types of forming operations. It is noted that the lower flange is not absolutely essential depending on the type of equipment employed to roll the skirt of the cap. The side wall of the skirt portion of the cap is knurled to facilitate gripping and rotation of the cap for removal. Now when it is desired to remove the cap, the user simply supports the container in one hand and grasps the skirt at the knurled portion in the other and rotates it relative to the container through approximately 90°. During this turning action the turned under portion of the skirt intermediate the cams, is deflected and deformed outwardly permitting removal of the cap by simply lifting it axially from the container. The lower terminal edge of the skirt is bent outwardly sufficient to clear the locking flange in the manner described in the previous embodiment. The conical configuration of the outer face of the locking flange allows for some spring back of the skirt without creating a binding situation thus facilitating easy removal of the cap.

Even though the invention has been described in connection with specific embodiments, it is not intended to limit the invention and changes and modifications may be made therein within the scope of the following claims.

What is claimed is:

1. A container-closure assembly comprising a container having a discharge opening, a flange of predetermined cross section projecting radially outwardly from said discharge opening having a side face diverging downwardly from the axial end face of the opening, a shaping surface below said flange of a cross section different than said flange, four circumferentially spaced cam members extending axially downwardly from said flange, said shaping surface intermediate said cam members being planar and of polygonal cross section, a cap having a top and a peripheral skirt portion engaging under said flange and engaging said shaping surface, said cap being of a deformable material whereby said skirt is shaped to a generally cylindrical shape by said cam members upon relative rotation of said cap and container.

2. A container-closure assembly as claimed in claim 1 wherein said flange is of generally circular cross section and wherein said skirt is shaped by said cam member to a larger diameter than said flange diameter.

3. A container having a discharge opening, a flange of predetermined cross section projecting radially outwardly from said discharge opening having a side face diverging downwardly from the axial end face of the opening, a shaping surface below said flange of a cross section different than said flange, four circumferentially spaced cam members extending axially downwardly from said flange, said shaping surface intermediate said cam members being planar and of polygonal cross section.

4. A container-closure assembly comprising a container having a discharge opening, a flange of predetermined cross section projecting radially outwardly from said discharge opening having a side face diverging downwardly from the axial end face of the opening, a shaping surface below said flange of a cross section different than said flange, at least one cam member extending axially downwardly from said flange and formed as a continuation of said side face, a cap having a top and a peripheral skirt portion of a predetermined axial depth so that the lower terminal edge thereof engages under said flange and engages said shaping surface, a portion of said terminal edge engaging said cam surface below said flange at a deformation area whereby said skirt is shaped to a generally circular shape by said cam member upon relative rotation of said cap and container.

5. An assembly as claimed in claim 4 including a pair of cam members disposed at diametrically opposed locations on said shaping surface.

6. An assembly as claimed in claim 4 including inclined ramp surfaces on opposite sides of said cam member.

7. An assembly as claimed in claim 4 including an auxiliary container mounted in said discharge opening of said container.

8. A container-closure assembly as claimed in claim 4 wherein the skirt is of a diameter slightly greater than said flange and less than the diameter of the circular trace of the cam at the deformation area.

9. A container-closure assembly comprising a container having a discharge opening, a flange of pre-determined cross section projecting radially outwardly from said discharge opening having a side face diverging downwardly from the axial end face of the opening, at least one cam member extending axially downwardly from said flange, a cap having a top and a peripheral skirt portion of pre-determined axial depth so that the lower terminal edge thereof engages under said flange, a portion of said terminal edge engaging said cam suface below said flange at a deformation area whereby said skirt is shaped to a cross section greater than the maximum cross section of said flange upon relative rotation of said cap and container.

10. A container having a discharge opening, a flange of a predetermined horizontal cross-section projecting radially outwardly from said discharge opening having a side face diverging downwardly from the axial end face of the opening, a shaping surface below said flange of generally elliptical cross-section different than said flange, at least one cam member having a cam surface extending axially downwardly from said flange formed as a continuation of said side face thereof, and which projects radially outward greater than the maximum radial projection of the side face of said flange.

11. A container as claimed in claim 10 including a pair of cam members disposed at diametrically opposed locations on said shaping surface wherein the distance between the high point on said cam is greater than the maximum horizontal cross-section of said flange.

12. A container as claimed in claim 10 wherein said cam surface extends downwardly at the same angle as said side face of said flange.

13. A container-closure assembly comprising a container having a discharge opening, a flange of predetermined cross section projecting radially outwardly from said discharge opening having a side face diverging downwardly from the axial end face of the opening, a shaping surface below said flange of a cross section different than said flange, at least one cam member having a cam surface extending axially downwardly from said flange and formed as a continuation of said side face, said cam surface projecting radially outwardly a greater distance than the maximum radial projection of the side face of said flange, a cap having a top and a peripheral skirt portion of a predetermined axial depth so that the lower terminal edge thereof engages under said flange and engages said shaping surface, a portion of said terminal edge engaging said cam surface below said flange at a deformation area whereby said skirt is shaped to a generally circular shape by said cam member upon relative rotation of said cap and container.

14. A container-closure assembly as claimed in claim 13 wherein the skirt and flange are of circular cross section and the skirt is of a diameter slightly greater than said flange and less than the diameter of the circular trace of the cam at the deformation area.

15. A container-closure assembly comprising a container having a discharge opening, a flange of predetermined cross section projecting radially outwardly from said discharge opening having a side face diverging downwardly from the axial end face of the opening, at least one cam member extending radially downwardly from said flange, a cap having a top and a peripheral skirt portion of predetermined axial depth so that the lower terminal edge thereof engages under said flange, a portion of said terminal edge engaging said cam surface below said flange at a deformation area whereby skirt is shaped to a cross section greater than the maximum cross section of said flange upon relative rotation of said cap and container.

16. A container-closure assembly as claimed in claim 15 including a pair of cam members at diametrically opposed locations on said shaping surface and wherein said skirt engages over said flange with a predetermined clearance and tightly engages the cams at the cam locations.

* * * * *